US006367913B1

(12) United States Patent
Anderson

(10) Patent No.: US 6,367,913 B1
(45) Date of Patent: Apr. 9, 2002

(54) SYSTEM AND METHOD FOR IMPROVING THE LIGHTFASTNESS OF COLOR PRINTOUTS

(75) Inventor: Richard Anderson, Escondido, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/702,438

(22) Filed: Oct. 31, 2000

(51) Int. Cl.[7] ..... B41J 2/21
(52) U.S. Cl. ..... 347/43
(58) Field of Search ..... 347/43, 15

(56) References Cited

U.S. PATENT DOCUMENTS 4,963,882 A * 10/1990 Hickman ..... 347/41

6,257,693 B1 * 7/2001 Miller et al. ..... 347/19

* cited by examiner

*Primary Examiner*—Thinh Nguyen

(57) ABSTRACT

This present invention is embodied in a printing system for improving the lightfastness of printed documents produced by a color printer. The present invention includes a preprogrammed lightfastness scheme that can be incorporated in any suitable color printer, such as an inkjet printer, for improving lightfastness of printed documents. In general, the present invention can include an inkjet printhead assembly that incorporates a preprogrammed lightfastness scheme directly into the printer driver for selectively improving color documents produced by an inkjet printer. A general lightfastness scheme can be developed for each class of inkjet printhead assemblies during manufacturing of the class of inkjet printhead assemblies.

20 Claims, 5 Drawing Sheets

REFLECTION DENSITY BEFORE FADE FOR 1 YR

| MEDIA | LAYDOWN OF COLORANT | DENSITY RED | GREEN | BLUE | CYAN | MAGENTA | YELLOW |
|---|---|---|---|---|---|---|---|
| WFC | 1X | 0.86 | 0.96 | 1 | 1.05 | 0.97 | 0.86 |
| WFC | 2X | 1.04 | 1.14 | 1.18 | 1.29 | 1.21 | 1.04 |
| WFC | 3X | 1.19 | 1.25 | 1.33 | 1.4 | 1.36 | 1.17 |
| TRANSPARENCIES | 1X | 1.61 | 1.58 | 1.39 | 2.07 | 1.91 | 1.2 |
| TRANSPARENCIES | 2X | 2.2 | 2.41 | 2.32 | 2.36 | 2.23 | 1.64 |
| TRANSPARENCIES | 3X | 2.15 | 2.31 | 2.29 | 2.37 | 2.25 | 1.89 |

FIG. 5A

REFLECTION DENSITY AFTER 1 YEAR SIMULATED LIGHT FADE

| MEDIA | LAYDOWN OF COLORANT | RED | GREEN | BLUE | CYAN | MAGENTA | YELLOW |
|---|---|---|---|---|---|---|---|
| WFC | 1X | 0.7 | 0.82 | 0.78 | 0.93 | 0.75 | 0.74 |
| WFC | 2X | 0.92 | 1 | 0.96 | 1.1 | 0.93 | 0.93 |
| WFC | 3X | 1.07 | 1.07 | 1.05 | 1.2 | 1.08 | 1.07 |
| TRANSPARENCIES | 1X | 1.43 | 1.43 | 1.1 | 1.8 | 1.63 | 1.02 |
| TRANSPARENCIES | 2X | 2.04 | 2.29 | 2.03 | 2.42 | 2.13 | 1.4 |
| TRANSPARENCIES | 3X | 2.04 | 2.23 | 2.13 | 2.37 | 2.1 | 1.65 |

FIG. 5B

CHANGE IN % REFLECTANCE AFTER 1 YEAR SIMULATED FADE

| MEDIA | LAYDOWN OF COLORANT | RED | GREEN | BLUE | CYAN | MAGENTA | YELLOW |
|---|---|---|---|---|---|---|---|
| WFC | 1X | 7% | 4% | 7% | 3% | 8% | 5% |
| WFC | 2X | 3% | 3% | 5% | 3% | 6% | 3% |
| WFC | 3X | 2% | 3% | 4% | 2% | 4% | 2% |
| TRANSPARENCIES | 1X | 1% | 1% | 4% | 1% | 1% | 3% |
| TRANSPARENCIES | 2X | 0% | 0% | 0% | 0% | 0% | 2% |
| TRANSPARENCIES | 3X | 0% | 0% | 0% | 0% | 0% | 1% |
| % IMPROVEMENT IN LIGHTFASTNESS 1X -> 3X LAYDOW | | 69% | 26% | 39% | 22% | 48% | 63% |
| % IMPROVEMENT IN LIGHTFASTNESS 1X -> 2X LAYDOW | | 55% | 28% | 36% | 5% | 25% | 43% |

FIG. 5C

SYSTEM AND METHOD FOR IMPROVING THE LIGHTFASTNESS OF COLOR PRINTOUTS

FIELD OF THE INVENTION

The present invention generally relates to inkjet and other types of printers and more particularly, to a novel printing system for improving the lightfastness of printed documents produced by a color printer. The present invention includes a preprogrammed lightfastness scheme that can be incorporated in an inkjet printhead for improving lightfastness of printed documents produced by a color printer, such as an inkjet printer.

BACKGROUND OF THE INVENTION

Inkjet printers are commonplace in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more print cartridges each having a printhead with ink ejecting nozzles. The carriage traverses over the surface of the print medium. An ink supply, such as an ink reservoir, supplies ink to the nozzles. The nozzles are controlled to eject drops of ink at appropriate times pursuant to command of a microcomputer or other controller. The timing of the application of the ink drops typically corresponds to the pattern of pixels of the image being printed.

In general, the small drops of ink are ejected from the nozzles through orifices or nozzles by rapidly heating a small volume of ink located in vaporization chambers with small electric heaters, such as small thin film resistors. The small thin film resistors are usually located adjacent the vaporization chambers. Heating the ink causes the ink to vaporize and be ejected from the orifices.

Specifically, for one dot of ink, a remote printhead controller, which is usually located as part of the processing electronics of the printer, activates an electrical current from an external power supply. The electrical current is passed through a selected thin film resistor of a selected vaporization chamber. The resistor is then heated for superheating a thin layer of ink located within the selected vaporization chamber, causing explosive vaporization, and, consequently, a droplet of ink is ejected through an associated orifice of the printhead.

However, in many inkjet printers, lightfastness is a problem where the document that is printed is exposed to high or prolonged fluxes of lights. As a result, color documents usually fade over time and become unpleasant. Also, since each ink color can have a different lightfastness, documents that contain different colors often fade unevenly. This causes an unattractive document because certain portions of the color document are faded more than other portions. One way that this problem has been addressed was with the development of inks with improved lightfastness. However, these inks can be expensive, are prone to failure and require larges amounts of development time.

Therefore, what is needed is an inexpensive and effective printing system for improving the lightfastness produced by a color printer without altering ink formulas or adding additional materials to stabilize a printed document. What is additionally needed is a preprogrammed lightfastness scheme that can be incorporated in a printer driver for a color printer for improving the lightfastness of the color printout. What is further needed is an inexpensive and effective printing system with balanced fading of color printouts.

SUMMARY OF THE INVENTION

To overcome the limitations in the prior art described above, and to overcome other limitations that will become apparent upon reading and understanding the present specification, the present invention is embodied in a printing system for improving the lightfastness of printed documents produced by a color printer. The present invention includes a preprogrammed lightfastness scheme that can be incorporated in any suitable color printer, such as an inkjet printer, for improving lightfastness of printed documents.

In general, the present invention can include an inkjet printhead assembly that incorporates a preprogrammed lightfastness scheme directly into the printer driver for selectively improving color documents produced by an inkjet printer. A general lightfastness scheme can be developed for each class of inkjet printhead assemblies before, during or after manufacturing of the class of inkjet printhead assemblies.

The lightfastness scheme could include a printing pattern for each color of the inkjet printhead. The printing pattern would be based on the general lightfastness that exists for each color. The printing pattern could be any suitable method for improving lightfastness of the color. For example, a predefined number of extra layers of a certain color ant could be printed during printing of that color ant based on empirical data collected regarding the colorant's optical density.

The lightfastness scheme can be controlled by a printer driver as software operating on a computer system that is connected to the inkjet printer or as firmware incorporated into the printer in a controller device. Also, the lightfastness scheme can be encoded on a memory device incorporated into inkjet printhead assembly itself. In this case, the memory device could also store other various printhead specific data. The data can include identification, warranty, characterization usage, empirical data regarding each colorant's optical density, etc. Information and can be written and stored at the time the printhead assembly is manufactured. The lightfastness scheme can be accessed and applied by the printer driver.

In another embodiment, the inkjet printhead assembly includes a distributive processor that has the ability to apply the lightfastness scheme during printing operations. The distributive processor can receive the lightfastness scheme from the memory device or from the printer driver. The distributive processor can make other decisions, such as making its own firing decisions for providing lightfastness control and for producing documents that will have colors that fade evenly. For example, the distributive processor can be preprogrammed to regulate the number of extra layers that are to be printed for certain colorants, depending on the quality of print and lightfastness desired by a user. In addition, the distributive processor can aid in calibrating the printhead assembly in real time.

The printing system can also include an ink supply device having its own memory and can be fluidically coupled to the printhead assembly for selectively providing ink to the printhead assembly when necessary.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

FIGS. 5A–5C illustrate empirical observations for lightfastness schemes.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
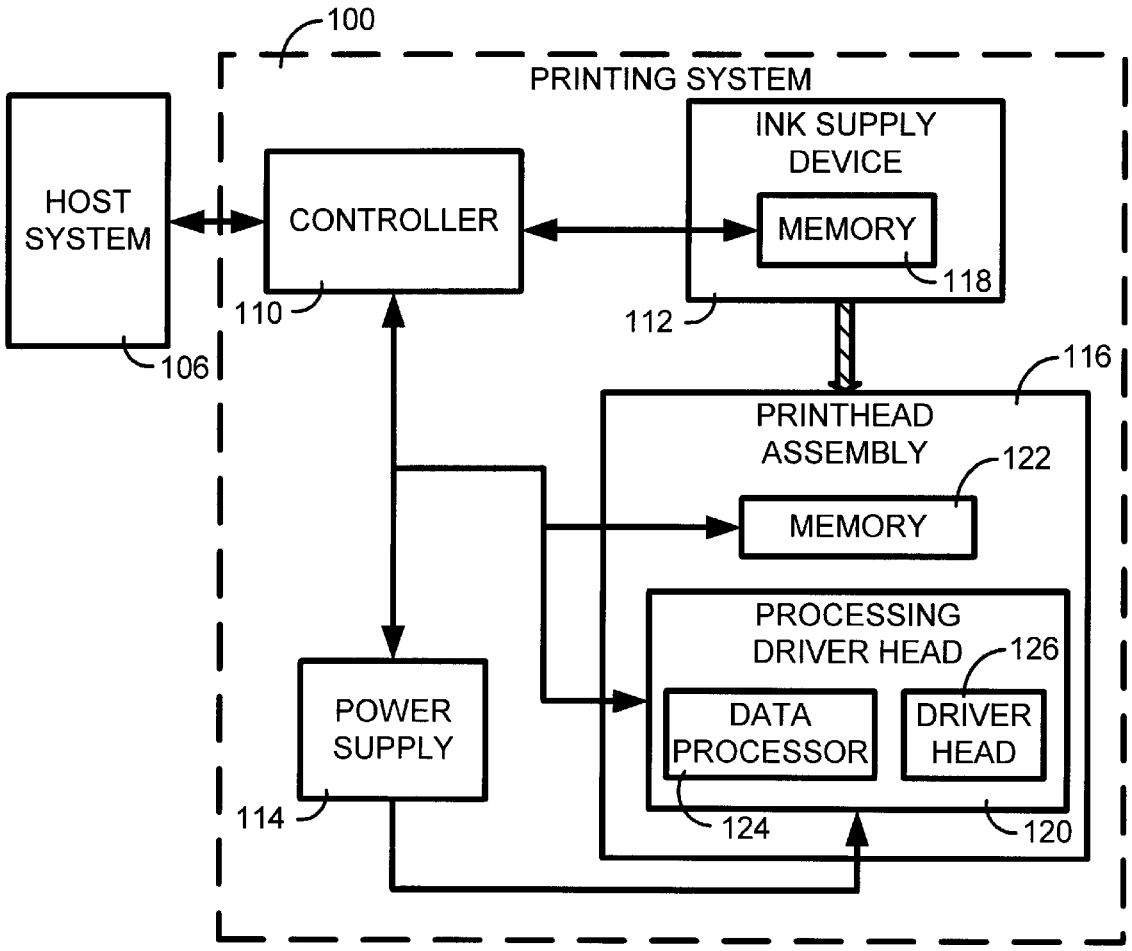
FIG. 1 shows a block diagram of an overall printing system incorporating the present invention.
Figure 2:
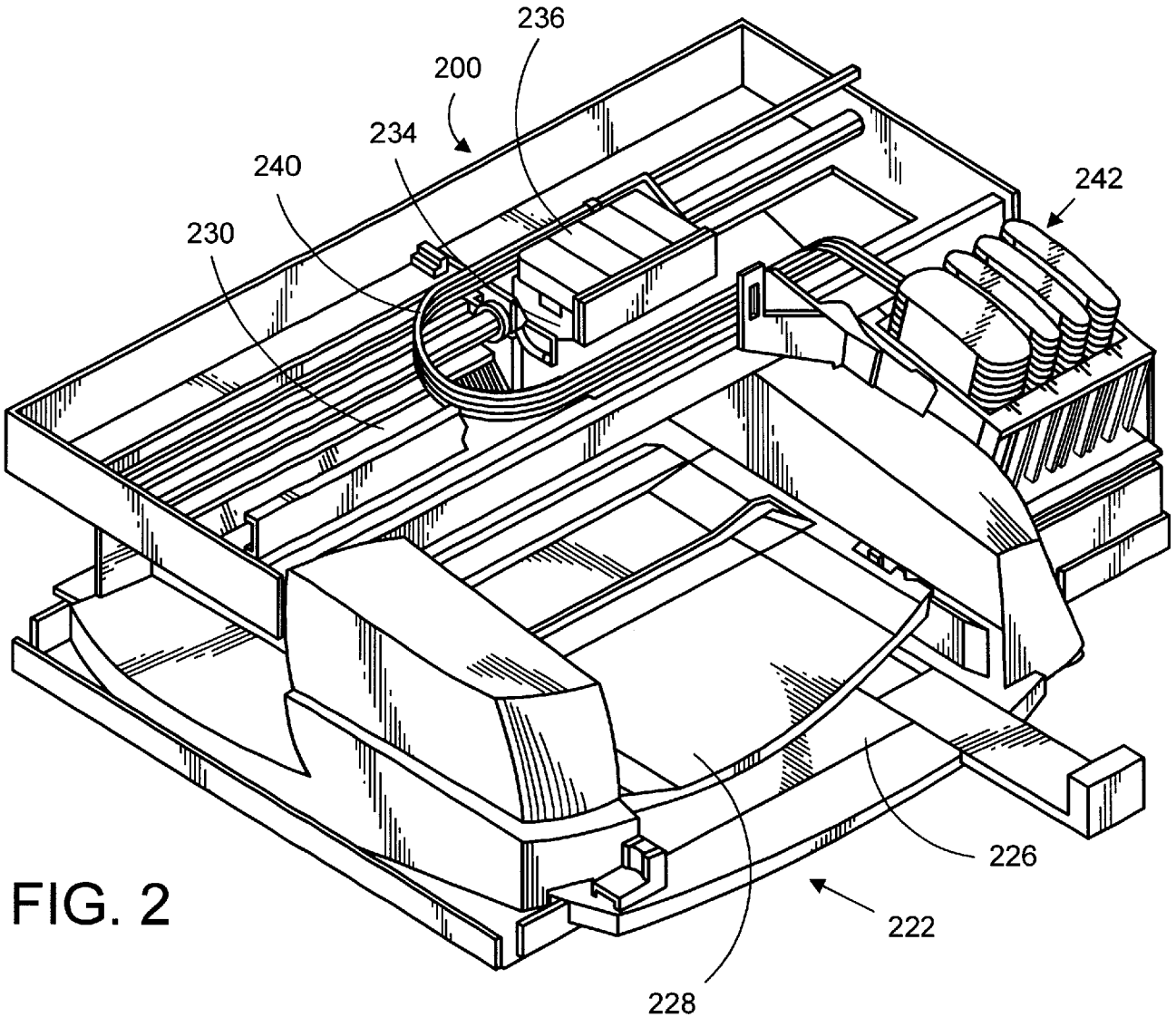
FIG. 2 is an exemplary printer that incorporates the invention and is shown for illustrative purposes only.

FIG. 1 shows a block diagram of an overall printing system incorporating the present invention. The printing system 100 can be used for printing a material, such as ink on a print media, which can be paper. The printing system can be an inkjet printer, as shown in FIG. 2. In many inkjet printers, lightfastness is a problem where the document that is printed is exposed to high or prolonged fluxes of lights. As a result, color documents usually fade over time and require reprinting. Also, since each ink color can have a different lightfastness, documents that contain different colors often fade unevenly. This causes an unattractive document because certain portions of the color document are faded more than other potions.

The present invention solves the problem of fading in general and uneven fading with lightfastness schemes that decrease fading and balance the fading process by selectively changing printing operations, such as the number of layers of ink drops printed for each color. The advantage of the present invention is that is inexpensive and effective for improving the lightfastness produced by a color printer without altering ink formulas or adding additional materials to stabilize the printed document. In addition, a preprogrammed lightfastness scheme can be incorporated in a printer driver.

In general, the printing system 100 of the present invention is electrically coupled to a host system 106, which can be a computer or microprocessor for producing print data. The printing system 100 includes a controller 110 coupled to an ink supply device 112, a power supply 114 and a printhead assembly 116. The ink supply device 112 can include an ink supply memory device 118 that is fluidically coupled to the printhead assembly 116 for selectively providing ink to the printhead assembly 116. The printhead assembly 116 can also optionally include a processing driver head 120 and a printhead memory device 122. The processing driver head 120 is comprised of a data processor 124, such as a distributive processor, and a driver head 126, such as an array of inkjet nozzles or drop generators. A printer driver can be incorporated as a firmware driver in the controller 110 or as a software driver in the host system 106.

During operation of the printing system 100, the power supply 114 provides a controlled voltage to the controller 110 and the processing driver head 120. Also, the controller 110 receives the print data from the host system and processes the data into printer control information and image data. The processed data, image data and other static and dynamically generated data (discussed in detail below), is exchanged with the ink supply device 112 and the printhead assembly 116 for efficiently controlling the printing system.

The ink supply memory device 118 can store various ink supply specific data, including ink identification data, ink characterization data, ink usage data, empirical data regarding each colorant's optical density and the like. The ink supply data can be written and stored in the ink supply memory device 118 at the time the ink supply device 112 is manufactured or during operation of the printing system 100.

Similarly, the printhead memory device 122 can store various printhead specific data, including printhead identification data, systematic ink drop placement errors, warranty data, printhead characterization data, printhead usage data, predefined lightfastness schemes, and empirical data regarding each colorant's optical density (discussed in detail below). This data can be written and stored in the printhead memory device 122 at the time the printhead assembly 116 is manufactured or during user operation, such as user initiated calibration or testing of the printing system 100.

The data processor 124 can communicate with memory devices 118, 122, the controller 110, and printer drivers, preferably in a bi-directional manner. The bi-directional communication enables the data processor 124 to dynamically formulate and perform its own operations based on data received by the connected devices, either stored static data or real time dynamic data. For example, the distributive processor 124 can be preprogrammed to regulate the number of extra layers that are to be printed for certain colorants, depending on the quality of print and lightfastness desired by a user.

These formulated decisions are preferably based on, among other things, previously stored information about each colorant and preprogrammed lightfastness schemes. As a result, the data processor 124 enables efficient operation of the processing driver head 120 and produces enhanced printed outputs.

II. Exemplary Printing System

Structural Components

FIG. 2 is an exemplary high-speed printer that incorporates the invention and is shown for illustrative purposes only. Generally, printer 20 can incorporate the printing system 100 of FIG. 1 and further include a tray 222 for holding print media. When a printing operation is initiated, print media, such as paper, is fed into printer 200 from tray 222 preferably using a sheet feeder 226. The sheet then brought around in a U direction and travels in an opposite direction toward output tray 228. Other paper paths, such as a straight paper path, can also be used.

The sheet is stopped in a print zone 230, and a scanning carriage 234, supporting one or more printhead assemblies 236 (an example of printhead assembly 116 of FIG. 1), is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) that utilize alternative media and/or printhead moving mechanisms, such as those incorporating grit wheel, roll feed or drum technology to support and move the print media relative to the printhead assemblies 236. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner as is the case for the system depicted in FIG. 2.

The print assemblies 236 can be removeably mounted or permanently mounted to the scanning carriage 234. Also, the printhead assemblies 236 can have self-contained ink reservoirs (for example, the reservoir can be located within printhead body 304 of FIG. 3) as the ink supply 112 of FIG. 1. The self-contained ink reservoirs can be refilled with ink for reusing the print assemblies 236. Alternatively, each print cartridge 236 can be fluidically coupled, via a flexible conduit 240, to one of a plurality of fixed or removable ink containers 242 acting as the ink supply 112 of FIG. 1. As a further alternative, the ink supplies 112 can be one or more ink containers separate or separable from printhead assemblies 116 and removeably mountable to carriage 234.

Figure 3:
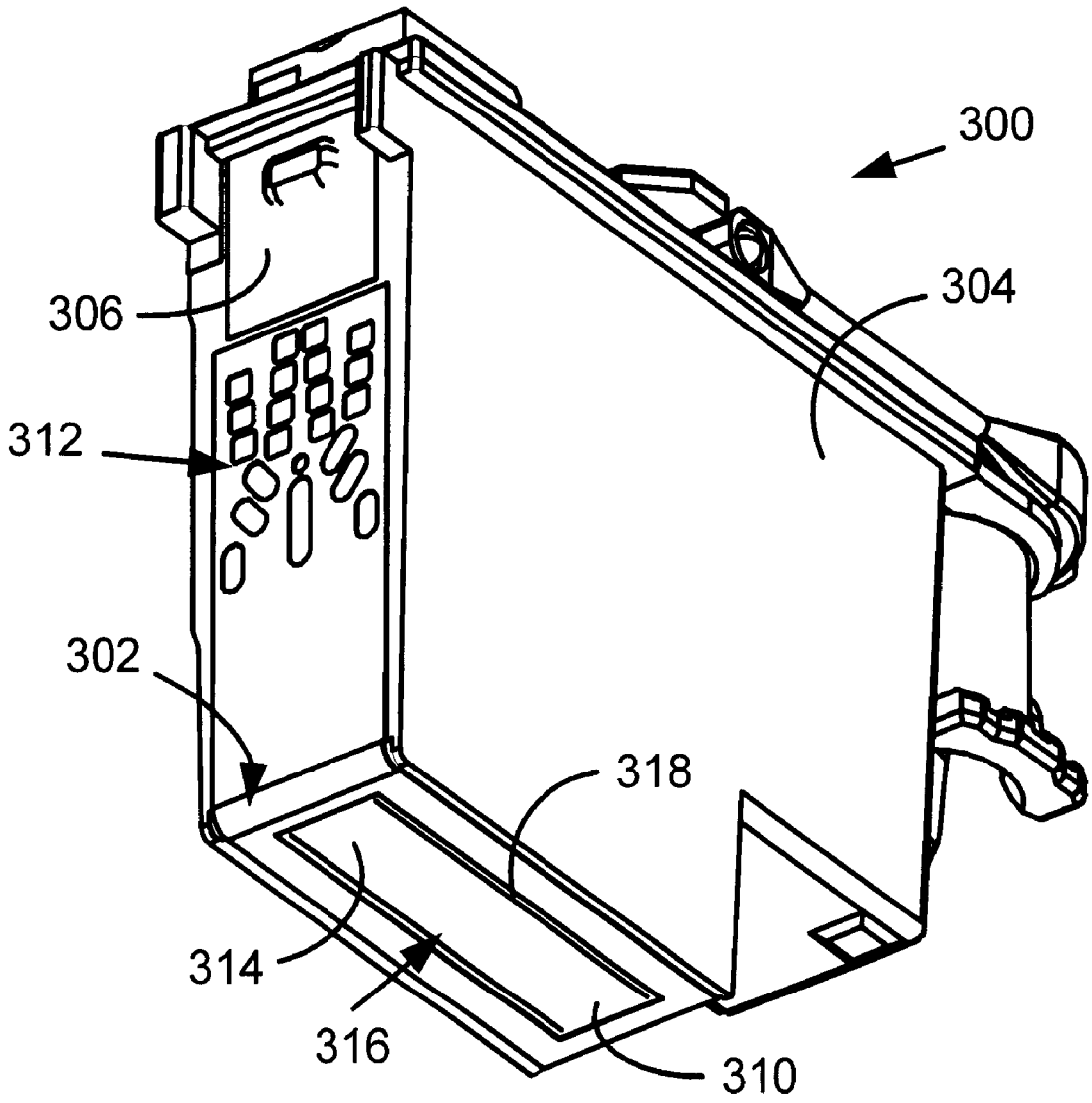
FIG 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 116 of FIG. 1) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal inkjet head assembly 302, a printhead body 304 and a printhead memory device 306, which is an example of memory device 122. The thermal head assembly 302 can be a flexible material commonly referred to as a Tape Automated Bonding (TAB) assembly and can contain a processing driver head 310 (an example of processing driver head 120 of FIG. 1) and interconnect contact pads 312. The interconnect contact pads 312 are suitably secured to the print cartridge 300, for example, by an adhesive material. The contact pads 308 align with and electrically contact electrodes (not shown) on carriage 234 of FIG. 2.

The processing driver head 310 comprises a distributive processor 314 (an example of the data processor 124 of FIG. 1) preferably integrated with a nozzle member 316 (an example of driver head 126 of FIG. 1). The distributive processor 314 preferably includes digital circuitry and communicates via electrical signals with the controller 110, nozzle member 316 and various analog devices, such as temperature sensors (described in detail below), which can be located on the nozzle member 316. The distributive processor 314 processes the signals for precisely controlling firing, correction schemes, timing, thermal and energy aspects of the printhead assembly 300 and nozzle member 316. The nozzle member 316 preferably contains plural orifices or nozzles 318, which can be created by, for example, laser ablation, for creating ink drop generation on a print media.

Lightfastness Scheme

Figure 4:
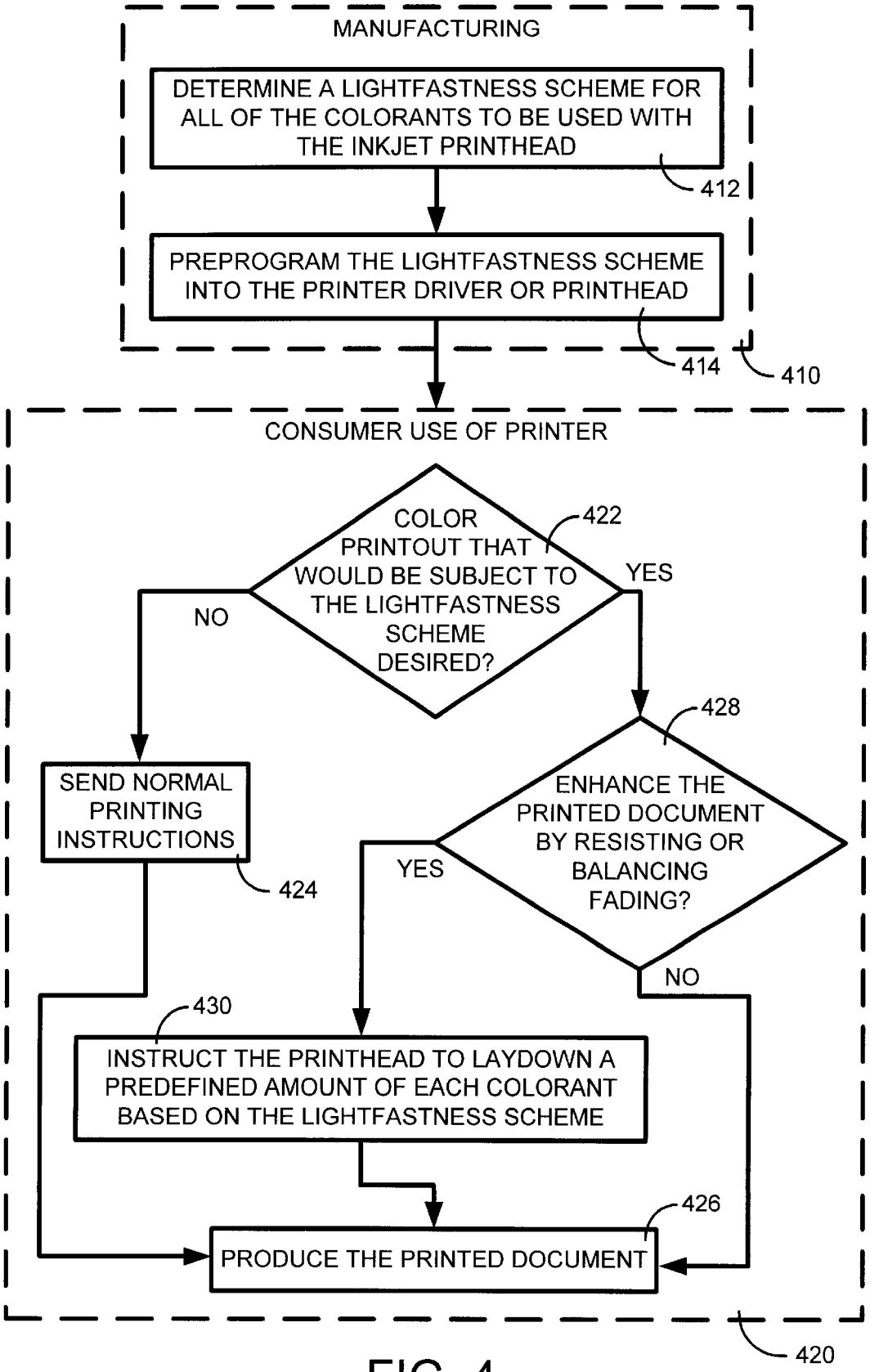
FIG. 4 is a block/flow diagram illustrating programming and use of the printhead during manufacturing and consumer use.

FIG. 4 is a high level flow diagram illustrating a lightfastness scheme used with a printhead and printing system described in FIGS. 1–3. In one embodiment, a general lightfastness scheme can be developed for each class of inkjet printheads 300 before, during or after manufacturing of the class of inkjet printheads 300 of FIG. 3. The lightfastness scheme could include a printing pattern for each color of the inkjet printhead 300 of FIG. 3. The printing pattern would be based on the general lightfastness that exists for each color. The printing pattern could be any suitable method for improving lightfastness of the color. For example, a predefined number of extra layers of a certain colorant could be printed during printing of that colorant based on empirical data collected regarding the colorant's optical density.

The following description refers to an embodiment that uses the general lightfastness scheme. Referring to FIG. 4, first, during a manufacturing process 410 of the colorants or the inkjet printhead, the reflection density after exposure to light for a predefined time period (to simulate fade) is compared to a number of laydown amounts of each colorant to determine a lightfastness scheme for all of the colorants to be used with the inkjet printhead (step 412). Second, the lightfastness scheme is preprogrammed into the memory devices 118, 122 or the controller/print driver 110 of FIG. 1 (step 414).

Third, during use of the printer 420, it is first determined whether a color printout is desired that would be subject to the lightfastness scheme (step 422). If not, the print driver would simply send normal printing instructions without additional lightfastness command (step 424) and produce a printout (step 426). If there was need for a color document subject to the lightfastness scheme, the user could be provided with the option to enhance the printed document by resisting or balancing fading with the caution that additional ink is used (step 428). Next, the print driver would instruct the printhead to laydown a predefined amount of each colorant based on the lightfastness scheme (step 430) to produce the printed document.

III. Working Example

Typically, inkjet printers are designed to achieve the greatest color range for a given print media by deciding the maximum amount of colorant in an ink that is to be deposited in an imaging pixel. Because there is perceived to be no value in increasing the level of colorant on the media beyond that needed to achieve the maximum density, the amount of colorant deposited on a pixel is set near or just above that needed to achieve the maximum reflection density.

The most common accepted measures of lightfastness are made by measuring the change in reflection density after exposure to light and expressing the lightfastness as a percentage of the reflection density lost as a result of exposure to light relative to the initial reflection density. This is most commonly done at relatively low reflection densities (e.g. 0.5 to 1.0 optical densities). At low reflection densities, the magnitude of fade measured by the change in percent reflectance and the change in reflection density are very similar. In general, the percentage of fade (percent reflectance) simulates the effect observed by the eye. At higher reflection densities (i.e. those near the highest density achievable for a given media), the percentage fade results do not reflect the effect observed by the eye. The metric that most closely resembles the effect observed by the eye is percent reflectance.

Empirical observations, as illustrated in FIGS. 5A–5C show that when colorant is deposited in excess of the amount required to achieve the maximum reflection density of a given media (i.e.=or >2x) the level of fade as measured by percent reflectance is greatly improved (a 20% to 70% improvement found in some cases) in a simulated one year light fade. Colors observed at higher colorant amounts often appear darker or richer to the eye and the visual difference between the faded and unfaded samples is much smaller than observed when standard colorant amounts are used.

The reason for this improvement in lightfastness is believed to occur because the extra colorant deposited does not effect the percent reflectance of the media (5% to 8% less light is transmitted). But, after the amount of colorant that is normally faded is lost in the image areas, there remains enough colorant to maintain the visual appearance of colorant virtually unchanged. As such, the invention uses a lightfastness scheme to control the inkjet printer driver to adjust the amount of colorant in a pixel that is deposited during a printing operation. The amount of colorant used during a printing operation can be based on the empirical results of FIG. 5C.

For example, if an image required cyan and red colorants, normally, a 1X amount of each colorant would be used. However, if the user desired a document that was more resistant to fading or a document with a balanced fade, the lightfastness scheme (incorporating the empirical data of FIGS. 5A–5C) of FIG. 4 could be preprogrammed into the print driver in accordance with the present invention to keep the amount of cyan colorant at 1X, but increase the amount of red colorant to 3X. In this case, as shown in FIG. 5C, the change in reflectance would be balanced (red would have a 2% change in reflectance and cyan would have a 3%, as opposed to red having a 7% change if only 1X were used). Preferably, between two to three times more colorant than the level required to achieve the maximum reflection density for a given media is used. The present invention can be used in any application that uses color printouts, for example, color printouts that are displayed as retail labels and signage.

The foregoing has described the principles, preferred embodiments and modes of operation of the present invention. However, the invention should not be construed as being limited to the particular embodiments discussed. As an example, the above-described inventions can be used in conjunction with any printers that use half tones to control the color levels, including thermal and non-thermal inkjet, offset printing and electrophotography. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printhead assembly comprising a processing driver head having a distributive processor integrated with an ink ejection driver head, the distributive processor being preprogrammed with a lightfastness scheme for selectively printing predefined amounts of colorants of an ink to increase ink density for improving lightfastness.

2. The printhead assembly of claim 1, wherein the lightfastness scheme improves lightfastness of printed documents produced by the printhead assembly by decreasing the range of color used and increasing colorant density.

3. The printhead assembly of claim 1, further comprising a general lightfastness scheme generated at least one of before, during or after manufacturing of a class of inkjet printhead assemblies.

4. The printhead assembly of claim 3, wherein the general lightfastness scheme includes ink density colorant adjustments that cover colorants that exist for an entire class of inkjet printhead assemblies.

5. The printhead assembly of claim 1, wherein the lightfastness scheme includes instructing extra layers of a certain colorant to be ejected during printing of that colorant.

6. The printhead assembly of claim 5, wherein the lightfastness scheme is based on empirical data collected regarding the optical density of each colorant.

7. The printhead assembly of claim 1, wherein the lightfastness scheme is controlled by a printer driver as software operating on a computer system that is connected to the printhead assembly.

8. The printhead assembly of claim 1, wherein the lightfastness scheme is preprogrammed as firmware and incorporated into a controller connected to the printhead assembly.

9. The printhead assembly of claim 1, wherein the lightfastness scheme is encoded on a memory device incorporated into printhead assembly.

10. The printhead assembly of claim 1, wherein the lightfastness scheme is generated at the time of at least one of printhead assembly manufacturing or printhead assembly operation.

11. A method for improving the lightfastness of colorants of a printed document produced by a printer, comprising:

generating a lightfastness scheme for at least some of the colorants to be used with the printer;

preprogramming the lightfastness scheme into a memory device associated with the printer; and ejecting predefined amounts of colorants of the ink to increase ink densities of each colorant based on the lightfastness scheme to improve lightfastness of the printed document.

12. The method of claim 11, wherein the lightfastness scheme is generated at the time of at least one of printhead assembly manufacturing or printhead assembly operation.

13. The method of claim 11, further comprising generating the lightfastness scheme based on empirical data collected regarding the optical density of each colorant.

14. The method of claim 11, wherein the lightfastness scheme improves lightfastness of printed documents produced by the printhead assembly by decreasing range of color used and increasing colorant density.

15. The method of claim 11, wherein a general lightfastness scheme is generated that includes ink density colorant adjustments that cover colorants that exist for an entire class of inkjet printhead assemblies.

16. An inkjet printing system comprising:

a controller;

a printhead assembly in bi-directional communication with the controller and having a distributive processor integrated with an ink ejection driver head; and wherein the distributive processor is preprogrammed with a lightfastness scheme for selectively printing predefined amounts of colorants of an ink to increase ink density for improving lightfastness as instructed by the controller.

17. The inkjet printing system of claim 16, further comprising an ink supply for providing ink to the printhead assembly.

18. The inkjet printing system of claim 17, wherein the ink supply is a removeably mounted ink container.

19. The inkjet printing system of claim 17, further comprising an integrated circuit having a plurality of nozzles for ejecting the ink supplied by the ink supply.

20. The inkjet printing system of claim 17, further comprising:

a media moving mechanism;

a printhead support mechanism that supports the printhead assembly in relation to the media moving mechanism; and an ink supply coupled to the printhead assembly for providing ink to the ink ejection driver head.

* * * * *